US005277541A

United States Patent [19]

Palmer

[11] Patent Number: 5,277,541

[45] Date of Patent: Jan. 11, 1994

[54] VANED SHROUD FOR CENTRIFUGAL COMPRESSOR

[75] Inventor: Donald L. Palmer, Cave Creek, Ariz.

[73] Assignee: Allied-Signal Inc., Morris Township, Morris County, N.J.

[21] Appl. No.: 813,241

[22] Filed: Dec. 23, 1991

[51] Int. Cl.[5] ..... F01D 5/04

[52] U.S. Cl. ..... 415/58.2; 415/58.3; 415/206; 415/914

[58] Field of Search ..... 415/58.2, 58.3, 203, 415/206, 914

[56] References Cited

U.S. PATENT DOCUMENTS

| | | | |
|---|---|---|---|
| 2,405,282 | 8/1946 | Birmann . | |
| 3,832,085 | 8/1974 | DeFauw et al. . | |
| 3,887,295 | 6/1975 | Yu . | |
| 4,086,022 | 4/1978 | Freeman et al. | 415/914 |
| 4,131,389 | 12/1978 | Perrone et al. . | |
| 4,212,585 | 7/1980 | Swarden et al. | 415/206 |
| 4,248,566 | 2/1981 | Chapman et al. . | |
| 4,479,755 | 10/1984 | Skoe . | |
| 4,540,335 | 9/1985 | Yamaguchi et al. . | |
| 4,630,993 | 12/1986 | Jensen . | |
| 4,659,288 | 4/1987 | Clark et al. | 416/186 R |
| 4,778,341 | 10/1988 | Corradini et al. | 415/58.2 |
| 4,781,530 | 11/1988 | Lauterbach et al. . | |
| 4,815,935 | 3/1989 | Gottemoller | 415/914 |
| 4,874,575 | 10/1989 | Dunn et al. | 415/206 |
| 4,904,158 | 2/1990 | Kun | 415/914 |

FOREIGN PATENT DOCUMENTS

| | | |
|---|---|---|
| 273364 | 6/1970 | U.S.S.R. . |
| 591619 | 2/1978 | U.S.S.R. . |
| 1132485 | 11/1968 | United Kingdom . |

*Primary Examiner*—Richard A. Bertsch
*Assistant Examiner*—Mark Sgantzos
*Attorney, Agent, or Firm*—James W. McFarland; Robert A. Walsh

[57] ABSTRACT

A centrifugal compressor impeller for gas turbine engines designed to efficiently operate at both part-speed and full speed design points includes slanted vanes in a secondary air inlet to the impeller. The vanes are tangentially slanted in the direction of rotation of the impeller to preferentially augment airflow into the impeller at maximum speed, while at part-speed discouraging airflow out of its impeller through the secondary inlet.

15 Claims, 3 Drawing Sheets

VANED SHROUD FOR CENTRIFUGAL COMPRESSOR

CROSS-REFERENCE TO RELATED APPLICATION

Similar subject matter is discussed in my commonly assigned copending patent application no. 812,674 entitled "Centrifugal Compressor" filed simultaneously herewith and incorporated herein by reference.

TECHNICAL FIELD

This invention pertains to centrifugal compressors as they may be utilized in gas turbomachinery such as gas turbine engines, and relates more particularly to improvements therein for enhancing compressor operation at separate design points of operation.

BACKGROUND OF THE INVENTION

Centrifugal compressors are often used in gas turbomachinery to compress and direct a pressurized air or gas flow to the gasifier section in a gas turbine engine. In the gasifier section a combustion process dramatically heats the gas flow which is then exhausted across one or more turbine stages to create rotational mechanical power and/or thrust through exhaust of the gas flow. Great care must be taken in the design and configuration of such centrifugal compressors to provide adequate operations at the desired speed while avoiding surge or stall of the compressor. Characteristically, the surge margin for compressors is an important criteria in their design and operation.

Many applications of modern gas turbomachinery such as gas turbine engines may optimally require operation of the compressor at two different design points, one point being the normal full power setting for the engine and a second, part speed design point, for lower power or cruise operations. The purpose of operating at two different design points is one of efficiency and minimization of the specific fuel consumption of the engine when considering its entire design operational envelope.

Difficulties are recognized in providing a compressor with such dual design point operation inasmuch as the compressor obviously must be designed to produce adequate flow at the required high speed or full power condition. When such compressor is then operated at reduced speed and power conditions, the impeller blade leading edge will be operating at high incidence angles relative to the air intake. This tends to create considerable pressure losses at the part-power operation due to these high incidence angles, and also greatly reduces the surge margin of the centrifugal compressor when operating at this part-power design point.

Various prior configurations are known which attempt to take advantage of the known "pressure reversal" which occurs at a downstream point on the compressor impeller when operating at either the part speed or full speed design points. Examples include U.S. Pat. Nos. 4,248,566 and 2,405,282.

SUMMARY OF THE INVENTION

It is an important object of the present invention to provide an improved centrifugal compressor of the class described wherein vaned passages are included around the outer circumference of the leading edge of the compressor blades within the surrounding shroud to present a plurality of radially inwardly disposed flow inlet paths to the compressor in addition to the primary air inlet at the front of the compressor. Importantly, passive elements, i.e. nonmoving vanes, promote secondary air inlet flow into the impeller at maximum power conditions, while simultaneously discouraging and preventing exhaust flow out of the compressor back to the inlet when operating at part speed operations.

More particularly, the present invention contemplates a plurality of vanes in the shroud which are highly tangentially angled in a circumferential sense in the direction of rotation of the compressor impeller. Rotation of the compressor impeller thereupon induces increased secondary air inlet flow into the impeller through these vaned shroud at maximum power conditions, while a tortuous flow path is presented for reverse flow attempting to flow out of the compressor therethrough back to the inlet duct when the compressor is at part speed operation.

Another important object of the present invention is to provide an improved compressor impeller designed to operate at two separate design speeds, wherein the forward impeller section of the compressor is deliberately designed to maintain maximum compressor efficiency at a part speed operational design point, and wherein a secondary air inlet of the class described augments the inlet air flow to the compressor to provide optimal operation when operating at maximum power design point.

Yet another object of the present invention is to provide such vanes angled in the direction of rotation in a radial direction, which are further angled generally normal to the impeller blade angle in an axial direction to minimize tip leakage between impeller blade spaces.

These and other objects and advantages of the present invention are specifically set forth in or will become apparent from the following detailed description of preferred arrangements of the invention, when read in conjunction with the accompanying drawings.

DETAILED DESCRIPTION OF THE PREFERRED EMBODIMENT

Figure 1:
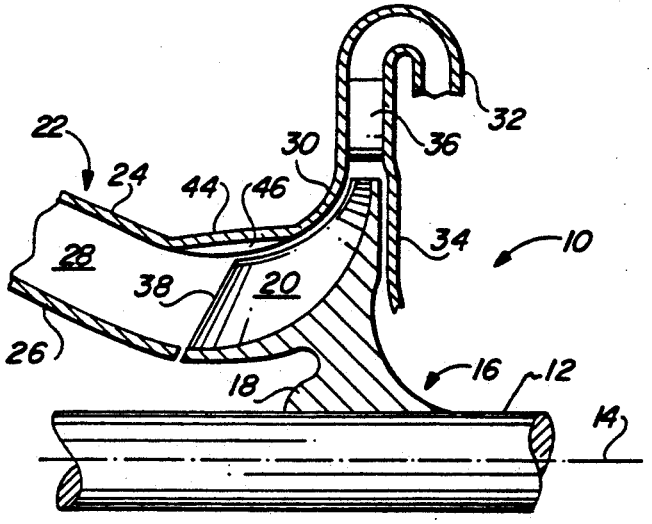
FIG. 1 is a partial, meridional cross sectional view of a portion of a gas turbine engine utilizing a centrifugal compressor and shroud of the present invention.
Figure 2:
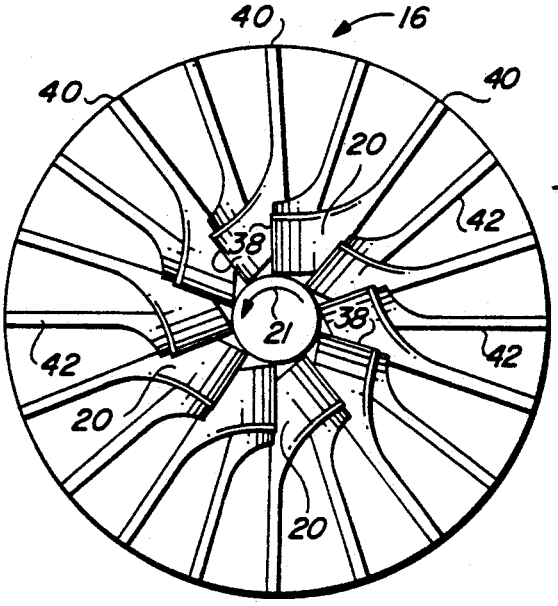
FIG. 2 is a front elevational view of the compressor.

Referring now more particularly to the drawings, a portion of a gas turbine engine 10 illustrated in FIG. 1 includes a high speed rotary shaft 12 rotatable about an axis 14 for driving a centrifugal compressor impeller 16 attached thereto. Impeller 16 conventionally includes a hub portion 18 and a plurality of impeller blades 20 which extend generally radially outwardly from the blade. The engine further includes a casing generally referred to by the numeral 22 which includes components 24 and 26 which define an annular inlet duct 28 through which the primary air flow or gas flow is directed to be received at the compressor. The casing further includes a compressor shroud 30, and additional compressor casing elements 32, 34. Shroud 30 is disposed closely adjacent the radial outer tips of all of the impeller blades 20.

Conventionally, the radially directed, compressed gas exiting the compressor impeller 16 radially outwardly is directed across diffuser vanes 36 into a diffusion section prior to delivery to either the next stage compressor or to the combustor of a gas turbine engine.

Figure 3:
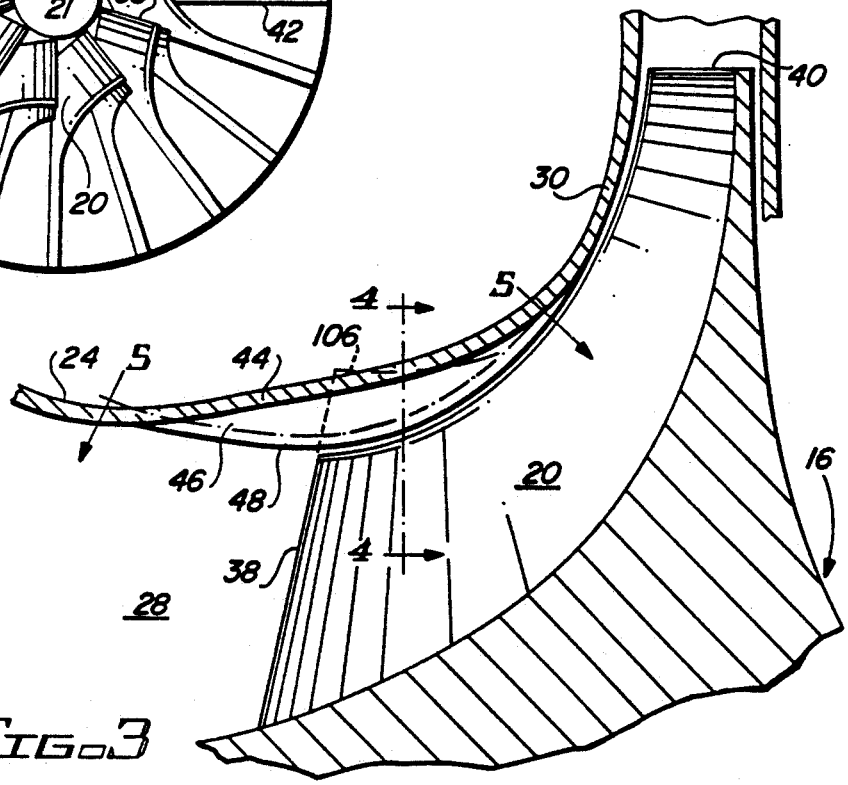
FIG. 3 is an enlarged view of the vaned shroud portion of FIG. 1, showing further details of construction.
Figure 4:
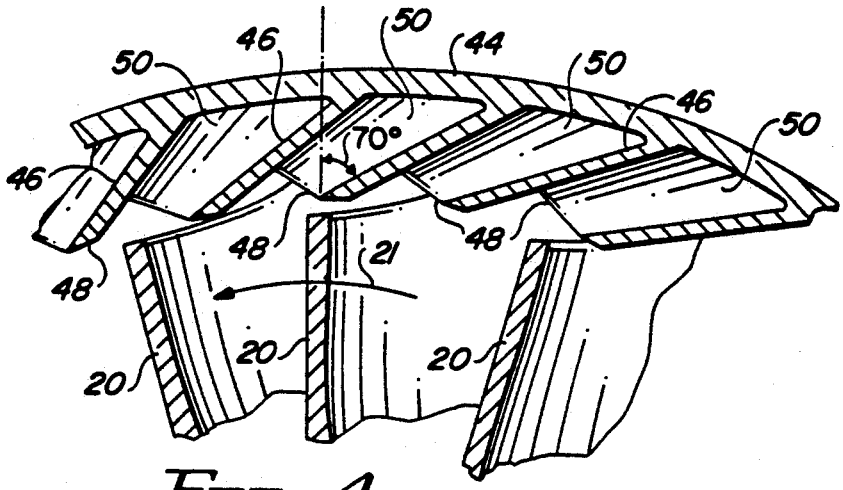
FIG. 4 is a plan cross sectional view of a portion of the compressor and the vaned shroud as viewed along lines 4—4 of FIG. 3.
Figure 5:
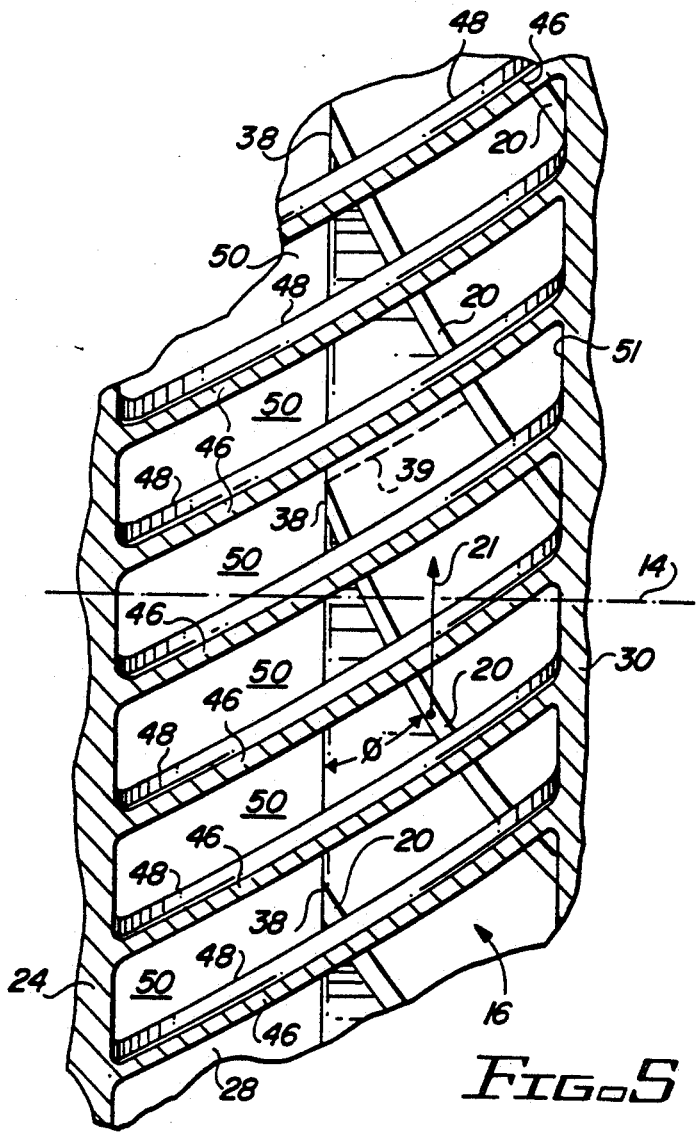
FIG. 5 is a radial inward cross-section as viewed along lines 5—5 of FIG. 3, and circumferentially unwrapped.

As illustrated in FIGS. 1-5 the centrifugal compressor impeller 16 includes impeller blades 20 having a forward inducer portion extending downstream from the inducer inlet leading edge 38 of each impeller blade 20. This entry inducer section extends somewhat generally axially before the airflow being compressed begins to turn radially outwardly before ultimately being delivered in a compressed state in a generally radially outward direction at the exit end 40 of the compressor impeller blades. FIG. 5 clearly illustrates that blades 20 are conventionally swept at an effective blade angle $\phi$ in an axially rearward direction. Partial splitter blades 42 may also be included between each blade 20.

An important aspect of proper operation of a compressor impeller is the control of the angle of incidence of the air inlet flow from inlet 28 onto the leading edge 38. This angle of incidence is the relative angle between the blade and the air direction at the blade leading edge 38. By convention, a positive sign for the angle of incidence denotes that the angle of the incoming air is higher than the angle of the leading edge of the blade, while negative angle of incidence occurs when the air angle is less than the blade angle. Excessive or high incidence angles on the blade leading edge are generally undesirable in that considerable pressure losses may be generated reducing the efficiency potential of the compressor. On the other hand, too high of negative leading edge incidence angles may induce very low pressures in the inducer section of the compressor which limits the total air flow and thus power of the engine.

The present invention is directed toward an improved shroud casing treatment adjacent the leading edges 38 of the compressor impeller blades 20 for the purpose of providing combinations of needed compressor characteristics which are operationally difficult to attain due to the aerothermodynamic limitations of compressors. One such characteristic is that adequate mass flow into and through the compressor is required at the highest compressor speed in order to generate the maximum full power for which the compressor is designed. Normally this is the typical condition for which the entire compressor is designed. That is, the size and blade or vane shape of each component of the compressor are normally set to this maximum power design point, including the impeller inducer section of the impeller.

In many aircraft applications, another highly desirable characteristic would be good compressor efficiency at a lower power setting to produce improved fuel economy in a cruise mode of operation. In such lower power conditions the compressor will be operating at reduced speed, flow and lower pressure ratio. In such lower power condition the compressor blade leading edges 38 will be operating at a high incidence angle relative to air inlet flow from inlet 28. Considerable pressure losses are generated in the forward inducer portion of the impeller by such high incidence angles, reducing the efficiency potential of the compressor at such conditions. Further, such high incidence angles force the compressor to operate at conditions far nearer stall or surge. Surge of the compressor is a complicated system phenomena which can be "triggered" by a rapid buildup of losses anywhere within the compressor. Thus at the impeller part speed, lower power conditions being discussed, considerable pressure losses generated in the forward inducer portion of the impeller by the high positive incidence angles of inlet airflow onto the blade leading edges 38 are of the type which may trigger surge. Further, the air inlet flow incidence angles, and the associated losses, increase yet further as the compressor is throttled. Throttling of the compressor may occur, for example, during compressor or engine acceleration because the aerothermodynamic components downstream of the compressor, (the power turbines not shown), present a flow restrictor to the compressor impeller 16. During acceleration the air flow is increasing in temperature and therefore expanding, reducing the amount of mass flow which may pass through the downstream fixed area turbine. Thus throttling of the compressor occurs. Accordingly, the high angles of incidence onto the leading edges 38 when operating at a lower power design point normally limits the surge-free acceleration capability of the compressor.

To produce improved operation of the compressor at both a part speed design point and a maximum power design point, the present invention includes a casing or shroud segment 44 displaced substantially radially outwardly from the leading edge 38 and the forward inducer portion of the impeller blades 20. Depending radially inwardly from this displaced outer circular wall segment 44 are a plurality of vanes 46 whose inner ends 48 are in close proximity to the outer radial tips of the impeller blades 20. Each of the slanted vanes 46 are axially arcuately convexly curved and otherwise complementary configured to the outer tips of these blades 20, as best depicted in FIGS. 1 and 3, to lie closely adjacent these outer tips of the blade along the length thereof.

The displaced segment 44 of the shroud, along with the radially inwardly depending or extending blades 46 extend forwardly of the leading edges 28 a substantial distance into the inlet 28, as well as axially rearwardly along the impeller blades 20 a substantial distance. As shown in FIG. 5, the blades 46 extend axially rearwardly along the length of the blades 20 a substantial distance past the throat 39 of the compressor impeller. Throat 39 is, of course, the location of minimum distance between adjacent compressor blades 20. As illustrated in FIG. 5, the vanes 46 preferably extend rearwardly past the throat 39 a sufficient axial distance such that the axially rearward-most point of the throat 39 is approximately 60% of the axial distance between the leading edge 38 and the axially rearward most portion 51 of each of the blades 46. The blades 46 extend forwardly of the leading edges 38 an axial distance of approximately 70 to 80% of the axial length of the vanes extending rearwardly from the leading edges 38.

The vanes 46 and the displaced segment 44 of the shroud thereby define an annular ring of vane passages 50 disposed around the outer periphery of the radial outer tips of the impeller blades 20 to provide a secondary path for air inlet flow into the impeller compressor in addition to the primary inlet flow at the blade leading edges 38.

As clearly depicted in FIG. 4, each of the stationary vanes 46 is severely slanted and angled in the direction of rotation of the compressor impeller. The direction of rotation of impeller 16 is illustrated by the arrow 21 in FIG. 4, and it will be noted that the radial innermost edge 48 of each of the blades 46 is slanted at a severe angle of approximately 70° to a radial line. This tangential slanting of blades 46 in a radial direction is, importantly, in the same direction as the direction 21 of rotation of the impeller blade.

In a preferred arrangement as illustrated in FIG. 5, each of the stationary vanes 46 is also twisted in an axial direction such that each of the blades 46 crosses the associated portion of the impeller blades 20 at a direction substantially normal to the blade. Such axial twisting of each vane 46 in a direction generally normal to the axial blade angle $\phi$ reduces pressure blade unloading as is associated with air flow between adjacent spaces defined between the blades 20 through the passages 50 presented by the blades 46.

Figure 8:
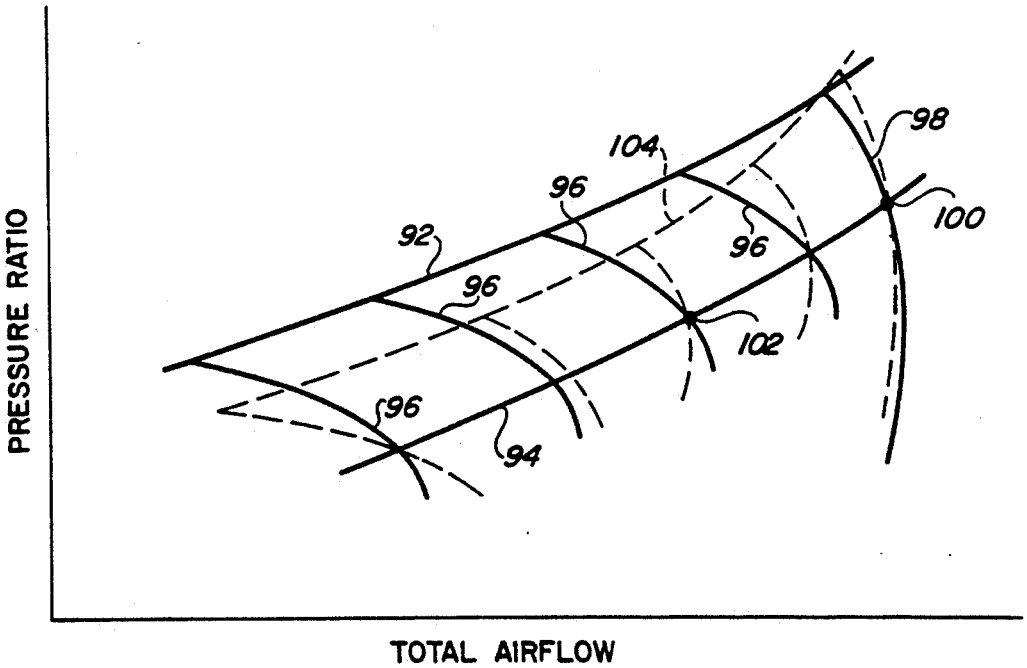
FIG. 8 is a compressor map illustrating the operational advantages of the present invention in comparison to normal compressor designs.

Operation of the present invention can be most readily understood by reference to the compressor map illustrated in FIG. 8. FIG. 8 is a plot of compressor ratio versus total air flow mass passing through the compressor, and characteristically includes a surge line 92 representative of the limits of stable compressor operation. That is, to the left and above surge line 92 the compressor experiences surge or stall and becomes inoperative from a practical standpoint. Line 94 represents a typical steady state operating line for a centrifugal compressor. Operation of the compressor in a condition between lines 94 and 92 creates compressor impeller acceleration, while operation below line 94 causes compressor deceleration. A plurality of lines of constant compressor speed are illustrated by 96 and are typically expressed in a normalized manner as percentages of maximum design speed. Thus, the rightmost line of constant speed 98 represents one-hundred percent or maximum power design operational speed of the compressor impeller. Point one-hundred illustrates steady state compressor operation at one-hundred percent design speed while point 102 is representative of a part speed design point. The part speed design point may typically be somewhere between 85 percent and 95 percent of maximum design speed.

For purposes of comparison, FIG. 8 includes dash lines 104 presenting an exemplary compressor map of a compressor not including the present invention, but designed to operate at both the maximum power design point 100 and the part speed design point 102. From FIG. 8 one clear advantage offered by the present invention is illustrated. More particularly the surge margin of the present invention offers a significant improvement in comparison to prior art structures at the part speed design point. Surge margin is, of course graphically illustrated in FIG. 8 as the distance between the steady state line 94 and the surge line 92.

In operation, at the maximum design and power speed point 100 for the compressor, air inlet flow from inlet 28 may be entering the leading edge 38 at a less than desirable incidence angle resulting in a reduced pressure area in the inducer portion of the compressor. Augmented secondary air inlet flow passes through the slanted vanes 46 into the compressor impeller. This augmented air flow thereby assures that the compressor has sufficient total air flow to operate at the 100 percent design speed operation. The highly slanted angle of the vanes 46 in the direction of impeller rotation assures that this secondary flow into the compressor impeller is enhanced.

While operating at part speed design point 102, the compressor impeller is rotating at a lower speed with a higher incidence angle at the leading edge 38 thereof. However, the slanted configuration of the vanes 46 strongly discourages and minimizes reverse fluid flow out of the compressor compeller through vane passages 50 to the inlet duct 28. This is true because, even though pressure in the inducer section underlying the vane passages 50 is now higher than that in the inlet duct 28, the slanted vanes 46 present a highly tortuous path for fluid flow to pass reversely radially outwardly through the vaned passages 50. To accomplish such exhaust, the air flow must virtually turn almost 180 degrees upon itself in order to exit outwardly through the secondary openings 50. Thus, the tangential component of the air flow being carried between the compressor impeller blades 20 strongly discourages outflow through the secondary opening at the part speed design point. Additionally, the slanted vanes 46 may be extended forwardly of leading edges 38 to further discourage this recirculation outflow at part speed.

Elimination of the outflow at the part speed design point has a positive impact in the operational efficiency of the compressor impeller. This is true because air flow out of the compressor, whether bleed flow or by leakage, is undesirable as the energy input already introduced into the air by the compressor is lost, and the engine is unable to produce power from the energy already imparted to that lost air flow. Assuming all other factors constant, such bleed or leakage flow out of the vaned passages 50 would otherwise always increase fuel consumption for a given power level.

The slanted vanes 46 also inhibit blade unloading which occurs by leakage between the interspaces formed between the blade vanes 20 by passing across the tips thereof 46. That is, the slanted vanes 46, being located very closely adjacent the outer tips of the impeller blades 20, minimizes leakage over the blade tips at this location. This is further enhanced by the axial twisting of vanes 46 such that they run generally normal to the tips of impeller blades 20.

Thus, the present invention incorporates the slanted vanes 46, slanted in the direction of rotation of the compressor impeller 16, to both discourage air flow out of the compressor through the vane passages 50 when operating at part design speed wherein pressure in the compressor impeller inducer section is higher than that in the inlet 28, and to enhance inflow of secondary air flow radially inwardly into the compressor to augment total air flow therein at the 100 percent maximum design point speed.

The advantages of the present invention can be understood in another manner. More particularly, in FIG. 3 a dashed line 106 is included which would be representative of the height of the inducer leading edge of a compressor blade which would be required to provide the same air inlet flow at 100 percent design speed as accomplished by the present invention which incorporates the secondary inlet 46. In other words, the compressor impeller of FIG. 3 is preferably designed such that the inducer portion, and more particularly the leading edge 38 thereof, is designed to produce optimal angles of incidence and relative Mach number at the leading edge when operating at the part speed design point. All of the aerodynamic elements downstream of the inducer section of the compressor are sized for operation at the 100 percent design speed point rather than the part speed design point. By designing the compressor with an inducer section providing optimal performance at the part speed design point, the inducer inlet leading edge is significantly shorter in radial height. Such shorter, stiffer blades are more rugged in configuration and may be fabricated at lower cost.

Importantly, even though the inducer inlet portion of the compressor is designed for optimal operation at the part speed design point rather than the 100 percent speed design point, the vanes 46 discourage and minimize leakage flow out of the compressor impeller when operating at this part speed design point, as discussed in detail above. At the same time, inclusion of the secondary air inlet with its slanted vanes 46 assures the augmented secondary air inlet flow required so that this compressor impeller can still make 100 percent design speed operation even though the inducer inlet portion thereof is designed for optimal operation at part speed design point.

From the foregoing it will be apparent that the present invention provides improved part power engine operation and efficiency because backflow from the impeller through vane passages 50 is discouraged. Part speed surge margin is significantly improved as illustrated in FIG. 8. This improvement in surge margin may also be more readily understood by recognizing that the inducer portion of the compressor blade can be ultimately designed for operation at point 102 on the compressor map. As noted, the configuration allows shorter and more rugged and less expensive configuration of the impeller blades themselves.

The present invention accomplishes all of these improvements without introduction of mechanical moving parts. That is, the passive device represented by the stationary vanes 46 acts to meter the amount of flow through the vane passages 50 in a preferential direction without introduction of moving parts.

Figure 6:
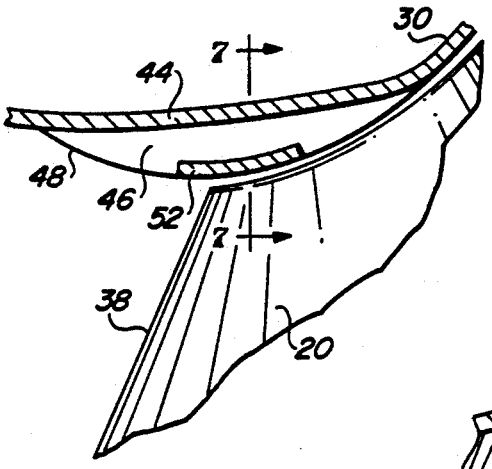
FIG. 6 is a view similar to FIG. 3 but showing an alternate embodiment.
Figure 7:
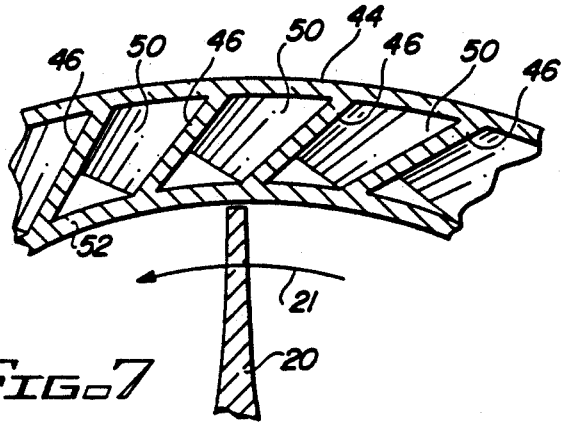
FIG. 7 is a cross-section taken along lines 7—7 of FIG. 6.

Illustrated in FIGS. 6 and 7 is an alternate version of the present invention which may be necessary for utilization with certain compressors to provide optimum efficiency therefor. The arrangement of FIGS. 6 and 7 is like that shown in FIGS. 1-5 except for the inclusion of an additional solid circular ring segment 52 at the radially inner edge 48 of each of the blades 46. This axially short ring 52 provides a continuous shroud segment very immediately adjacent the tips of the leading edges 38 to minimize leakage thereacross at that location. The FIG. 6 and 7 embodiment is otherwise constructed as set forth with respect to FIGS. 1-5 and operates in the manner set forth previously.

The foregoing detailed description of preferred arrangements of the invention should be considered exemplary in nature and not as limiting to the scope and spirit of the invention as set forth in the appended claims.

Having described the invention with sufficient clarity that those skilled in the art may make and use it, what is claimed is:

1. A centrifugal gas compressor comprising:

a centrifugal impeller having a forward inducer inlet, a hub, and a plurality of radial impeller blades having leading edges at said inducer inlet;

a stationary shroud disposed adjacent the radial outer tips of said blades in surrounding relation to said impeller, said shroud including a displaced segment displaced radially outwardly from said outer tips, said segment extending axially forwardly of said leading edges and extending axially rearwardly of said leading edges past the throat of said imepeller; and a plurality of stationary slanted vanes having radially outer ends joined with said displaced segment and radially inner ends located closely adjacent said outer tips, said vanes being tangentially slanted such that said inner ends are located downstream of their respective outer ends in relation to the direction of rotation of said impeller.

2. A compressor as set forth in claim 1, wherein said vanes extend axially rearwardly past said throat of the impeller.

3. A compressor as set forth in claim 2, wherein said vanes extend axially forwardly from said leading edges a distance at least as far as the maximum axial distance between said leading edges and said throat.

4. A compressor as set forth in claim 1, wherein said impeller blades are axially twisted at an effective blade angle $\phi$.

5. A compressor as set forth in claim 4, wherein said vanes are axially twisted at an angle approximately normal to $\phi$.

6. A centrifugal gas compressor comprising:

a centrifugal impeller having a forward inducer inlet, a hub, and a plurality of radial impeller blades having leading edges at said inducer inlet;

a stationary shroud disposed adjacent the radial outer tips of said blades in surrounding relation to said impeller, said shroud including a displaced segment displaced radially outwardly from said outer tips, said segment extending axially forwardly of said leading edges and extending axially rearwardly of said leading edges past the throat of said impeller;

a plurality of stationary slanted vanes depending radially inwardly from said displaced segment to inner ends located closely adjacent said outer tips, said vanes being tangentially slanted in the direction of rotation of said impeller; and an axially thin, solid circular ring extending between said inner ends of said vanes, said ring disposed around said leading edges of the impeller blades and being axially shorter than said vanes.

7. A compressor as set forth in claim 1, wherein said radially inner ends of said vanes are convexly curved to conform with the configuration of said outer tips of the blades.

8. A compressor as set forth in claim 1, wherein said inlet receives inlet air flow from an ambient air source.

9. In a gas turbine engine:

a centrifugal compressor impeller having a forward inducer inlet, a hub, and a plurality of impeller blades extending generally radially from said hub;

a stationary shroud disposed adjacent the radial outer tips of said blades in surrounding relation to said impeller, said shroud including a displaced segment displaced radially outwardly from said outer tips, said segment extending axially forwardly of said leading edges and extending axially rearwardly of said leading edges past the throat of said impeller; and a plurality of stationary slanted vanes having radially outer ends joined with said displaced segment and radially inner ends located closely adjacent said outer tips, said vanes being tangentially slanted such that said inner ends are located downstream of their respective outer ends in relation to the direction of rotation of said impeller, whereby said vanes (a) preswirl airflow flowing from said inlet through passages formed between said vanes into said impeller at high impeller speeds, and (b) discourage and minimize reverse flow of pressurized air from the impeller through said passages.

10. A gas turbine engine as set forth in claim 9, wherein said vanes extend axially rearwardly past said throat of the impeller.

11. A gas turbine engine as set forth in claim 10, wherein said vanes extend axially forwardly from said leading edges a distance at least as far as the maximum axial distance between said leading edges and said throat.

12. A gas turbine engine as set forth in claim 11, wherein said radially inner ends of said vanes are convexly curved to conform with the configuration of said outer tips of the blades.

13. A gas turbine engine as set forth in claim 9, wherein said inlet receives inlet air flow from an ambient air source.

14. A gas turbine engine as set forth in claim 9, wherein said impeller blades have forward inducer sections and leading edges configured and arranged to produce low loss incidence angle to inlet gas flow and low inlet flow relative Mach number at said part-speed design point.

15. In a gas turbine engine, a centrifugal compressor designed for operation at a part-speed design point and a full speed design point, comprising:

a centrifugal impeller having a forward inducer section adjacent the primary inlet to the impeller, a hub, and a plurality of impeller blades extending generally radially from said hub, said inducer section configured and arranged to produce low loss incidence angle to inlet gas flow and low inlet flow relative Mach number at said part-speed design point;

a stationary shroud disposed adjacent the radial outer tips of said blades in surrounding relation to said impeller, said shroud including a displaced segment displaced radially outwardly from said outer tips, said segment extending axially forwardly of said leading edges and extending axially rearwardly of said leading edges past the throat of said impeller; and a plurality of stationary slanted vanes inwardly having radially outer ends joined with said displaced segment and radially inner ends located closely adjacent said outer tips, said vanes being tangentially slanted such that said inner ends are located downstream of their respective outer ends in relation to the direction of rotation of said impeller, whereby said vanes preswirl secondary gas inlet flow into said impeller at said full speed design point.

* * * * *